United States Patent [19]

Bush

[11] Patent Number: 4,511,898

[45] Date of Patent: Apr. 16, 1985

[54] TERMINATED INVERTED V ANTENNA WITH MATCHING TRANSFORMER

[75] Inventor: Elmer R. Bush, Bethlehem, Pa.

[73] Assignee: Timetco Corporation, Bristol, Pa.

[21] Appl. No.: 506,837

[22] Filed: Jun. 22, 1983

[51] Int. Cl.[3] ..... H01Q 11/06

[52] U.S. Cl. ..... 343/736; 343/860

[58] Field of Search ..... 343/733, 736, 739, 787, 343/788, 860, 861

[56] References Cited

U.S. PATENT DOCUMENTS 1,899,410 2/1933 Bruce ..... 343/736

*Primary Examiner*—E. Lieberman

[57] ABSTRACT

A terminated, end-fed inverted V antenna provides continuous coverage over the 1.8 to 30 MHz frequency range. A special matching transformer is an integral part of the antenna system.

5 Claims, 2 Drawing Figures

TERMINATED INVERTED V ANTENNA WITH MATCHING TRANSFORMER

BACKGROUND OF THE INVENTION

Wire antennas may be grouped into two categories: resonant, and non-resonant or terminated. The common half-wave dipole is an example of the resonant antenna while a rhombic antenna is an example of a non-resonant type. In a resonant antenna current flows back and forth, reflecting from each end, while in a non-resonant antenna the current flows once through and is absorbed in a load, usually a resistor equal to the impedance of the antenna viewed as a transmission line. For a given length of wire, resonant antennas are more efficient, but they suffer from narrow bandwidths and broad radiation patterns. Non-resonant antennas function over a very wide range of frequencies, and can be made extremely directive when made long in terms of the wavelengths being radiated.

SUMMARY

This invention provides a non-resonant antenna with exceptionally wide bandwidth, matching a 50 ohm coaxial cable transmission line with a VSWR of less than 2:1 from 1.8 MHz to 30 MHz. It is an effective radiator and receiver of radio waves over this frequency spectrum, even though it is only approximately 0.2 of a wavelength in length at the lower frequencies and mounted very close to the ground in terms of wavelengths. An rf matching transformer of special design is included in the antenna and is believed to account for the significant improvements in frequency coverage provided by this antenna.

OBJECTS

One object of this invention is to provide an antenna that will function over a wide range of frequencies, so that radio systems users that must change frequencies over a large spectrum will be able to function without recourse to many antennas. Another object of the invention is to provide such a frequency-agile antenna that can be operated by unskilled radio operators who would be unable to tune and adjust complex matching circuits or choose appropriate antennas. The provision of a constant feed point impedance is thus another object of this invention.

Another object of the invention is the provision of an antenna that is relatively small compared to the wavelengths being transmitted and received, and that may be erected without requiring large towers and the like. A further object of the invention related to its surroundings is the provision of an antenna that does not require large scale grounding or courterpoise structures, and that is tolerant of differing ground conditions of conductivity or reflectivity.

PRIOR ART

The principles underlying non-resonant terminated antennas have been well known for many years, even though not as often used as resonant antennas. Bohm, in U.S. Pat. No. 2,207,504, (1940) shows a terminated end fed inverted V wire antenna similar to the antenna portion of this invention as typical art prior to his invention. No special matching devices to operate over a broad frequency spectrum are used by Bohm, however. Goodbody, in U.S. Pat. No. 3,803,615 (1974) discloses techniques for resistive loading shipboard wire antennas to attain broad frequency coverage. Naval communications systems have commonly employed non-resonant antennas. The metal superstructure of a ship has many reflecting and parasitic elements to disturb antennas, and Goodbody teaches how additional terminating resistors may be added at places other than the ends of the antennas to smooth out the impedance over a wide frequency spectrum. He also points out that it is difficult, and sometimes impossible, to find a matching network to match an antenna to a radio over a 3:1 frequency band. This is much less than the almost 17 to 1 frequency spectrum covered by this invention.

DETAILED DESCRIPTION OF THE INVENTION

Figure 1:
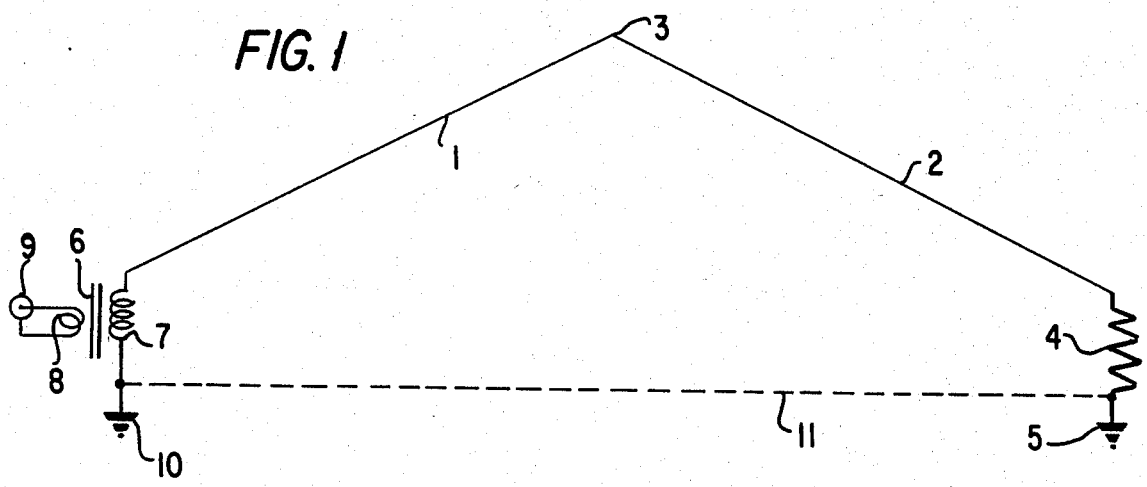
FIG. 1 is a schematic diagram of the antenna.

In FIG. 1 an inverted V antenna wire is shown with sloping legs 1 and 2 and a high middle portion 3. In general, the longer these sloping wires of the inverted V, the more efficient is the antenna. I have found a length of 55 feet for sloping portions 1 and 2, or an overall length of 110 feet, to be a good compromise between the requirements for efficiency and for reasonable size. With this length, the middle portion 3 should be approximately 25 to 35 feet high. The inverted V may be skewed, with the high portion 3 not precisely in the middle of the wire, without substantially affecting the antenna's performance. The length and height of the inverted V wire portion may be reduced proportionally if space is limited, with a corresponding loss in radiation efficiency. The impedance and SWR remain the same.

Resistor 4 is connected between one end of a sloping wire and ground. It has a value of 600 to 800 ohms and a power rating of approximately half the output power of the transmitter feeding the system, for intermittent service such as SSB or CW transmissions. The purpose of resistor 4 is to absorb and dissipate antenna currents and thereby prevent reflections from the end of the antenna. The ground connection 5 is to be made by means of a rod driven into the earth or some other standard technique well known in antenna art. It should be noted that the requirements for a good ground, and for good conductivity in the surrounding ground are not so severe as for other types of antennas requiring grounds. A quarter wave monopole mounted above ground or a ground plane, has a very low impedance, and the antenna and ground nearby must conduct relatively high current. This antenna has a higher impedance relative to the ground so that much smaller currents and much poorer ground connections and conductivity are possible here.

At the other end of the inverted V wire, radiofrequency transformer 6 is connected. Its secondary winding 7 is connected between the antenna wire 1 and another ground terminal 10. The secondary has an impedance of approximately 800 ohms. The low impedance primary, typically having an impedance of 50 ohms to match transmitting types of coaxial cable, is connected to a coaxial connector to receive the transmission line from the radio. In locations where no ground connections are possible, such as a roof top, or where the surrounding ground has practically no conductivity, such as a desert, a counterpoise wire 11 may be used to simulate a ground.

Figure 2:
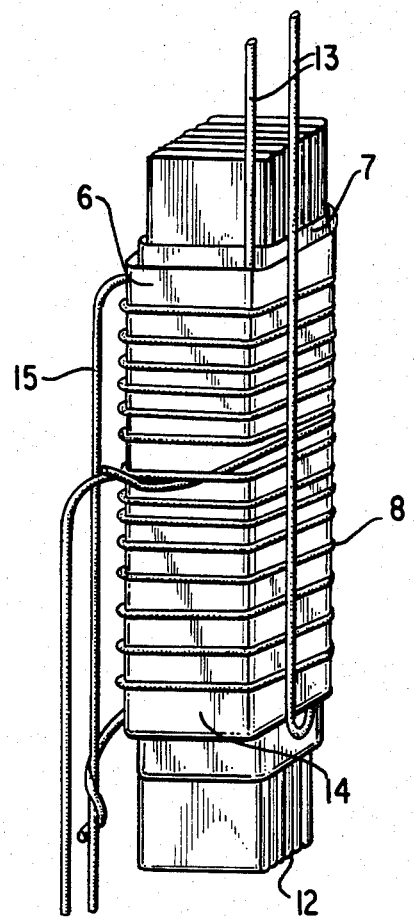
FIG. 2 is a perspective view of the core and windings of the radiofrequency transformer that is part of the antenna system of this invention.

In FIG. 2 the details of the construction of the rf transformer 6 are shown. The transformer is wound on a laminated ferrite core 12 which has the laminations glued together and sealed by covering with a moisture-proof seal. The laminations are Q-1 ferrite material, in strips five inches long, three quarters of an inch wide, and one eighth of an inch thick. Six strips comprise one core. The secondary winding 7 is wound on the core first, made up of 23 turns of No. 14 AWG heavy Formvar insulated copper wire. The secondary leads 13 are bent to emerge from the transformer at the same end. The secondary is coverd with insulating material and the primary wound on top of the secondary. The primary consists of two coils in parallel, spaced out over the entire length of the secondary coil. Each has 7 turns of No. 14 AWG heavy Formvar insulated copper wire. Note that the two coils fed from wire lead 15 are wound in the same direction around the core.

The details of the rf transformer may appear to be routine, but it is believed that this configuration of core material, core geometry, and windings contributes to the success of the antenna, particularly at the lower frequencies. Below approximately 4 MHz the antenna appears resistive with a capacitive reactance component, and the leakage reactance of the transformer is believed to assist in matching and balancing the antenna to the feedline.

Another significant factor in preserving a constant feedpoint impedance is the grounding of the transmission line independently of the antenna. The connection to the outer braid of the coaxial cable at connector 9 is not joined to the secondary and antenna ground 10. The outer conductor of the cable is believed to be at varying rf potentials at different frequencies of operation of this antenna system. If the coaxial cable is grounded at the antenna, the impedance of the antenna is changed and the VSWR as seen by the transmitter increases materially. With the antenna system as disclosed here, the VSWR remains below 2:1 over the frequency range from 1.8 to 30 MHz. It may be included in a radio communications systems so that unskilled operators may change frequencies without changing antennas or tuning matching networks, or without the expense of automatic equipment to accomplish such changes.

The antenna system of this invention has two important parts: a terminated non-resonant inverted V that has been well known and used for a half century or more, and a particular transformer whose structure and proportions were developed for but one purpose, improving the impedance characteristics of that antenna. Other transformers have been tested, some with "better", or more ideal transformer characteristics, that did not approach the effectiveness of the transformer here disclosed. The antenna's remarkable frequency coverage is realized only with the rf transformer as an integral part.

I claim:

1. A wideband coaxial cable fed antenna system for continuous coverage of the 1.8 MHz to 30 MHz frequency spectrum comprising an antenna wire in an inverted V configuration having two wire segments sloping generally downward from an elevated middle portion of said antenna, a terminatng resistor connected between one end of said inverted V antenna wire and an electrical ground connection, and a radiofrequency transformer having a longitudinally laminated ferrite bar core of generally rectangular cross-section, a low impedance primary winding adapted for connection to a coaxial cable transmission line, and a high impedance secondary winding connected between the end of said inverted V antenna wire remote from said resistor terminated end and an electrical ground connection.

2. A wideband coaxial cable fed antenna system for continuous coverage of the 1.8 MHz to 30 MHz frequency spectrum comprising an antenna wire in an inverted V configuration having two wire segments sloping generally downward from an elevated middle portion of said antenna, at least one counterpoise wire located beneath said antenna wire extending generally horizontally between the ends of said inverted V antenna wire, a terminating resistor connected between one end of said inverted V antenna wire and said counterpoise wire, a radiofrequency transformer having a longitudinally laminated ferrite bar core of generally rectangular cross-section, a low impedance primary winding adapted for connection to a coaxial cable transmission line, and a high impedance secondary winding connected between the end of said inverted V antenna wire remote from said resistance terminated end and said counterpoise wire.

3. An antenna system according to claim 1 in which said inverted V antenna wire is approximately 110 feet long, and the height of said elevated middle portion is approximately 30 feet.

4. An antenna system according to claim 1 in which said terminating resistor has a value of approximately 800 ohms.

5. An antenna system according to claim 1 in which said radiofrequency transformer has a secondary winding of 23 turns wound about said core, and said low impedance primary winding comprises two coils of 7 turns each connected electrically and magnetically in parallel with each other and wound over said secondary coil.

* * * * *